US006260952B1

(12) United States Patent
Feinn et al.

(10) Patent No.: US 6,260,952 B1
(45) Date of Patent: Jul. 17, 2001

(54) APPARATUS AND METHOD FOR ROUTING POWER AND GROUND LINES IN A INK-JET PRINTHEAD

(75) Inventors: James A. Feinn, San Diego, CA (US); Jeffery Steven Beck, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/296,943

(22) Filed: Apr. 22, 1999

(51) Int. Cl.[7] ..... B41J 2/14; B41J 2/16
(52) U.S. Cl. ..... 347/50; 347/58
(58) Field of Search ..... 347/50, 58, 63, 347/64

(56) References Cited

U.S. PATENT DOCUMENTS

| | | | | |
|---|---|---|---|---|
| 4,663,640 | | 5/1987 | Ikeda | 347/63 |
| 4,719,477 | | 1/1988 | Hess | 347/59 |
| 4,862,197 | * | 8/1989 | Stoffel | 347/59 |
| 5,045,870 | * | 9/1991 | Lamey et al. | 347/59 |
| 5,317,346 | | 5/1994 | Garcia | 347/65 |
| 5,909,202 | * | 6/1999 | Cathey | 345/74 |

OTHER PUBLICATIONS

Hewlett–Packard Journal, Feb., 1994 pp. 41–45.
Hewlett–Packard Journal, May, 1985 pp. 27–33.
Hewlett–Packard Journal, Aug. 1992 pp. 77–83.

* cited by examiner

*Primary Examiner*—John Barlow
*Assistant Examiner*—Michael S. Brooke

(57) ABSTRACT

An ink-jet printhead having a thin film substrate, the substrate including a plurality of thin film layers including a gold thin film layer overlying a tantalum thin film layer, an underlying passivation layer and an aluminum thin film layer underlying the passivation layer. A portion of the substrate is disposed adjacent an outer edge thereof and an ink barrier layer overlies the thin film substrate, the barrier layer having a first edge. The substrate portion extends beyond the barrier layer first edge. A plurality of bond pads is disposed on the substrate portion. Power and ground traces are coupled to a respective bond pad and are dropped through vias in the substrate portion to the thin film aluminum layer underlying the passivation layer. The traces are returned through vias to the gold thin film layer at a location separated from the barrier first edge. The gold and tantalum material between the vias is removed thereby providing a region in the printhead wherein the barrier layer directly adheres to the passivation layer.

19 Claims, 4 Drawing Sheets

APPARATUS AND METHOD FOR ROUTING POWER AND GROUND LINES IN A INK-JET PRINTHEAD

BACKGROUND OF THE INVENTION

The present invention relates generally to printheads for ink-jet printers and, more particularly, to techniques for routing power and ground lines in an ink-jet printhead.

The art of ink-jet printing is relatively well developed. Commercial products such as computer printers, graphics plotters, and facsimile machines have been implemented with ink-jet technology for producing printed media.

Generally an ink-jet image is formed when a precise pattern of dots is ejected from a printhead onto a printing medium. Typically, an ink-jet printhead is supported on a movable cartridge that traverses over the surface of the print medium and is controlled to eject drops of ink at appropriate times pursuant to command of a microcomputer or other controller, wherein the timing of the application of the ink drops is intended to correspond to a pattern of pixels of the image being printed. Typically, the cartridge includes the printhead and an ink reservoir.

A typical Hewlett-Packard ink-jet printhead includes an array of precisely formed nozzles in an orifice plate that is attached to a thin film substrate that implements ink firing heater resistors and apparatus for enabling the resistors. The thin film substrate is generally comprised of several thin layers of insulating, conducting or semiconductor material that are deposited successively on a supporting substrate in precise patterns to form, collectively, all or part of an integrated circuit. Deposition can be performed by mechanical, chemical or by vacuum evaporation methods.

An example of the physical arrangement of the orifice plate, ink barrier layer, and thin film substrate is illustrated at page 44 of the Hewlett-Packard Journal of February 1994. Further examples of ink-jet printheads are set forth in commonly assigned U.S. Pat. No. 4,719,477 and U.S. Pat. No. 5,317,346, both of which are incorporated herein by reference.

In a conventional ink-jet print cartridge, the printhead is formed using Tape Automated Bonding (TAB) and the printhead includes a nozzle member comprising two parallel columns of offset orifices formed in a flexible polymer tape by, for example, laser ablation. The tape is commercially available as, for example, Kapton™ from 3M Corporation. Other suitable tape may be formed of Upilex™ or its equilivalent. A back surface of the tape (i.e. the surface opposite the surface facing the recording medium) includes conductive traces formed thereon by a conventional photolithographic etching or plating process. The conductive traces are terminated by large contact pads designed to interconnect with a printer. In general, the print cartridge is installed on a printer so that the contact pads, on the front surface of the tape, contact printer electrodes providing externally generated electrical signals to the printhead.

Since the traces are formed on the back surface of the tape, access to them from the front of the tape is provided by vias formed through the front surface of the tape to expose the ends of the traces. These exposed ends are plated, with gold for example, to form the contact pads on the tape front. Typically, windows extending through the tape are used to facilitate bonding of the other ends of the conductive traces to electrodes on a silicon substrate containing heater resistors. The windows are filled with an encapsulant to protect underlying traces and substrate.

In the printhead, an ink barrier layer defining ink channels, is disposed between the thin film substrate and the orifice plate. Ink drop generator regions are formed by the ink chambers and portions of the thin film substrate and of the orifice plate that are adjacent the ink chambers.

The thin film substrate is typically comprised of compositions such as silicon nitride ($S_3N_4$) and silicon carbide (SiC) on which are formed various thin film layers that form thin film ink firing resistors, apparatus for enabling the resistors, and interconnections to the bonding pads. In this regard, thin film topography can have a significant impact on printhead function. A typical thin film stack includes a plurality of thin film layers in which, for example, a silicon passivation layer is formed over a metallization layer and a tantalum passivation layer is deposited over the silicon layer. Finally, a gold layer is formed over the tantalum layer whereby the gold comprises the conductive traces and the bond pads. The gold layer is bonded to the ink barrier layer.

Generally, gold does not adhere well to other materials. With respect to the ink barrier layer, delamination between barrier material and gold is a concern. Such delamination can result in ink shorts, defined as electrical shorting, dendrite growth and electrochemical corrosion. This is especially the case near the tab bond window which comprises the interface between the bond pads and the thin film substrate and where ground, power and data lines on the flexible TAB circuit are bonded to the thin film substrate. Reliance on the encapsulant and adhesive techniques has not eliminated the delamination problem.

The problem of ink shorts in regions of delamination is exacerbated by the use of some newer inks. These contain organic solvents that can degrade adhesion between the ink barrier layer and the gold layer.

In view of the foregoing, it is apparent that a need exists for an ink-jet printhead having improved lamination quality combined with compatability with the newer corrosive inks.

DISCLOSURE OF THE INVENTION

In accordance with the present invention, an improved ink-jet printhead and method of producing the same are provided wherein the printhead includes a thin film substrate, the substrate including a plurality of thin film layers including a gold thin film layer overlying a tantalum thin film layer, an underlying passivation layer and an aluminum thin film layer underlying the passivation layer. An ink barrier layer overlies the thin film substrate while a portion of the substrate extends beyond an edge of the ink barrier layer. A plurality of bond pads is disposed on the substrate portion adjacent the ink barrier layer edge. Power and ground lines are coupled to respective bond pads and are routed through vias in the substrate portion to the thin film aluminum layer underlying the passivation layer. The traces are returned through vias to the gold thin film layer at a substrate location separated from the barrier edge. The gold and tantalum material between the vias is no longer needed and a printhead is provided having a region wherein the barrier layer directly adheres to the passivation layer.

The present invention affords several advantages. For example, it overcomes prior art constraints in aluminum by enabling routing of higher voltage power traces to aluminum, under the passivation layer, while the lower voltage ground traces remain above in the gold layer. This reduces the likelihood of electrical shorting and substantially eliminates the space constraints problem. Thus, the present invention affords a printhead design wherein the power and ground lines are separated by passivation from the barrier layer. Since separation occurs near the TAB bond window where delamination and electrical shorting are found in conventional printheads, these problems are eliminated. All power, ground and data lines can be routed by utilizing the novel technique set forth herein.

Another noteworthy advantage of the invention is improved lamination quality achieved because the tantalum and gold in the region of the bond pads can be removed. It is known that passivation cannot be reliably deposited on gold and thus the present invention removes this prior art limitation since the underlying passivation layer can now be exposed to the ink barrier layer for reliable bonding.

Further, the present invention eliminates topography associated with gold and tantalum layers and affords cost savings by eliminating the need for adding passivation layers above the gold.

Other aspects and advantages of the present invention will become apparent from the following detailed description, taken in conjunction with the accompanying drawings, illustrating by way of example the principles of the invention.

BEST MODE FOR CARRYING OUT THE INVENTION

The present invention may be embodied in other specific forms without departing from its spirit or essential characteristics. The described embodiment is to be considered in all respects only as illustrative and not restrictive. The scope of the invention is, therefore, indicated by the appended claims rather than by the description thereof. All changes which come within the meaning and range of equivalency of the claims are to be embraced within their scope.

Figure 1:
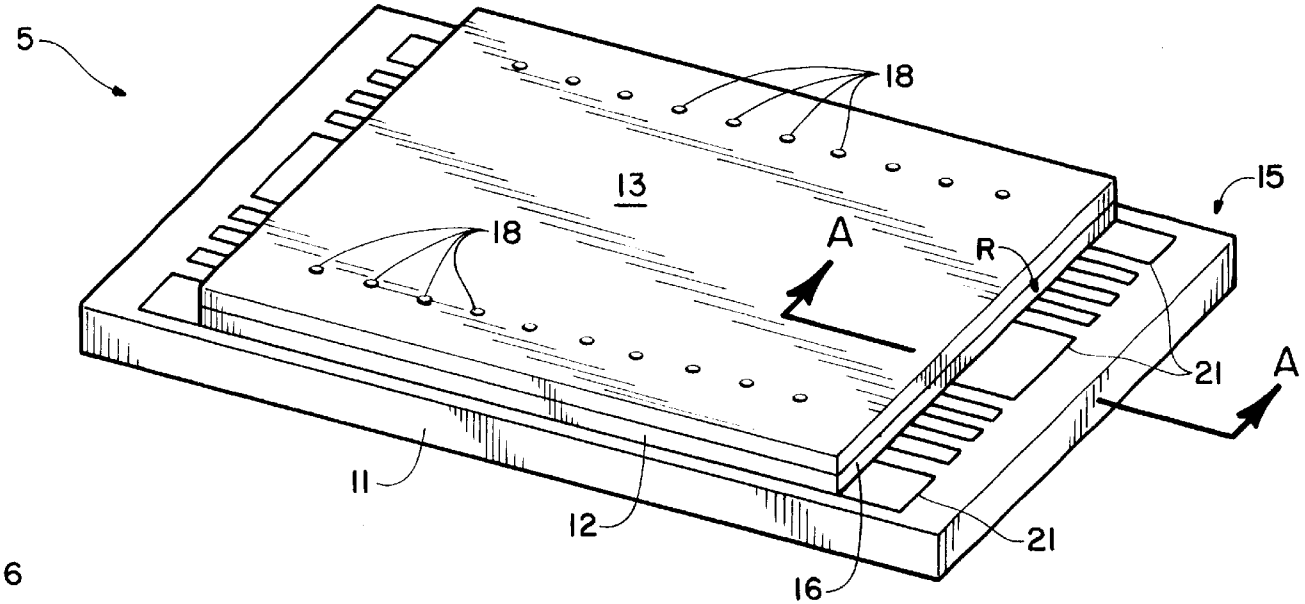
FIG. 1 is an unscald schematic perspective view of a conventional ink-jet printhead.

In the following detailed description and in the several figures of the drawings, like elements are identified with like reference numerals. Referring to the drawings, and in particular to FIG. 1, there is shown a schematic perspective view of an ink-jet printhead 5 which is constructed according to the present invention. The printhead 5 generally includes (a) a thin film substructure or die 11 comprising a substrate such as silicon and having various thin film layers formed thereon, (b) an ink barrier layer 12, disposed on the thin film substructure 11, and (c) an orifice or nozzle plate 13 attached to the top of the ink barrier layer 12.

The thin film substructure 11 is formed according to conventional integrated circuit techniques and includes a plurality of stacked thin film layers. It includes a portion 15 that extends beyond a barrier layer first edge 16.

The ink barrier 12 is formed of a dry film that is pressure laminated to the thin film substrate 11 or a wet dispensed liquid cast film that is subsequently spun to uniform thickness and dried by driving off excess solvent. The barrier layer 12 is photo defined to form therein ink chambers (not shown) and ink channels (not shown) which are disposed over resistor regions (not shown). By way of illustrative example, the barrier layer material comprises an acrylate photopolymer dry film such as the Parad™ brand photopolymer obtainable from E.I. duPont de Nemours and Company of Wilmington, Del. Similar dry films include other duPont products, such as RistonTm brand dry film, and dry films made by other chemical providers.

Gold and tantalum bond pads 21 engagable for external electrical connections are located on the portion 15 at the end of the thin film substrate 11. It will be noted that the bond pads 21 are not covered by the ink barrier layer 12.

The orifice plate 13 comprises, for example, a planar substrate comprised of a polymer material and in which the orifices are formed by laser ablation as disclosed, for example, in commonly assigned U.S. Pat. No. 5,469,199, incorporated herein by reference.

Figure 2:
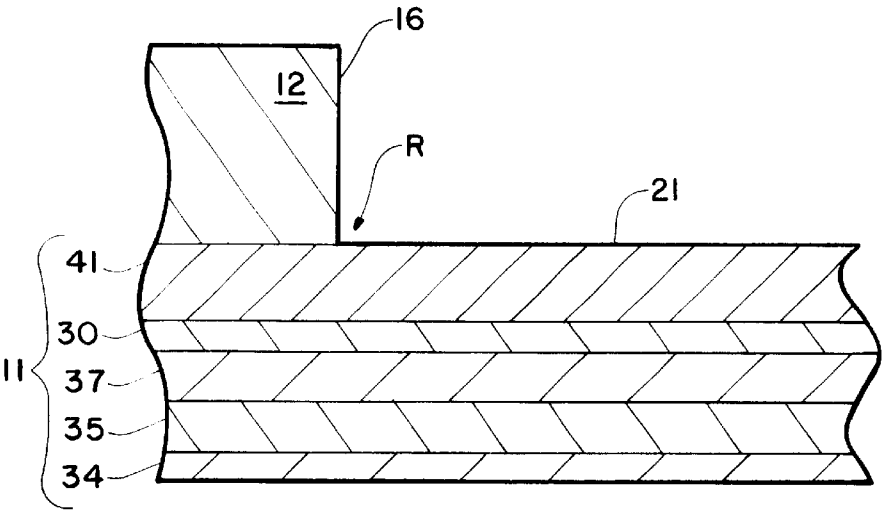
FIG. 2 is an unscaled schematic view taken along the line A—A of FIG. 1 showing the barrier/substrate interface of a conventional printhead.

FIG. 2 depicts the relationship between the ink barrier layer 12 and the thin film substrate 1 1 as it exits in a conventional printhead. The thin film substrate 11 includes a portion 15 (FIG. 1) that extends beyond the barrier layer 12. The substrate 11 is comprised of a passivation layer 37 of silicon nitride ($Si_3N_4$) and silicon carbide (SiC) composition. The passivation layer 37 is formed over an aluminum layer 35 which, in turn, is disposed over a tantalum/aluminum layer 34. A tantalum thin film layer 30 is disposed over the passivation layer 37 while a gold thin film layer 41 overlies the tantalum layer 30. The gold thin film layer is bonded to the ink barrier layer 12.

Since gold does not bond well with the barrier material, regions of delamination can develop at the gold thin film layer/barrier interface, indicated generally by the letter R. The existence of delamination under the barrier results in electrical shorting, especially when the newer, more corrosive inks are utilized.

Figure 3:
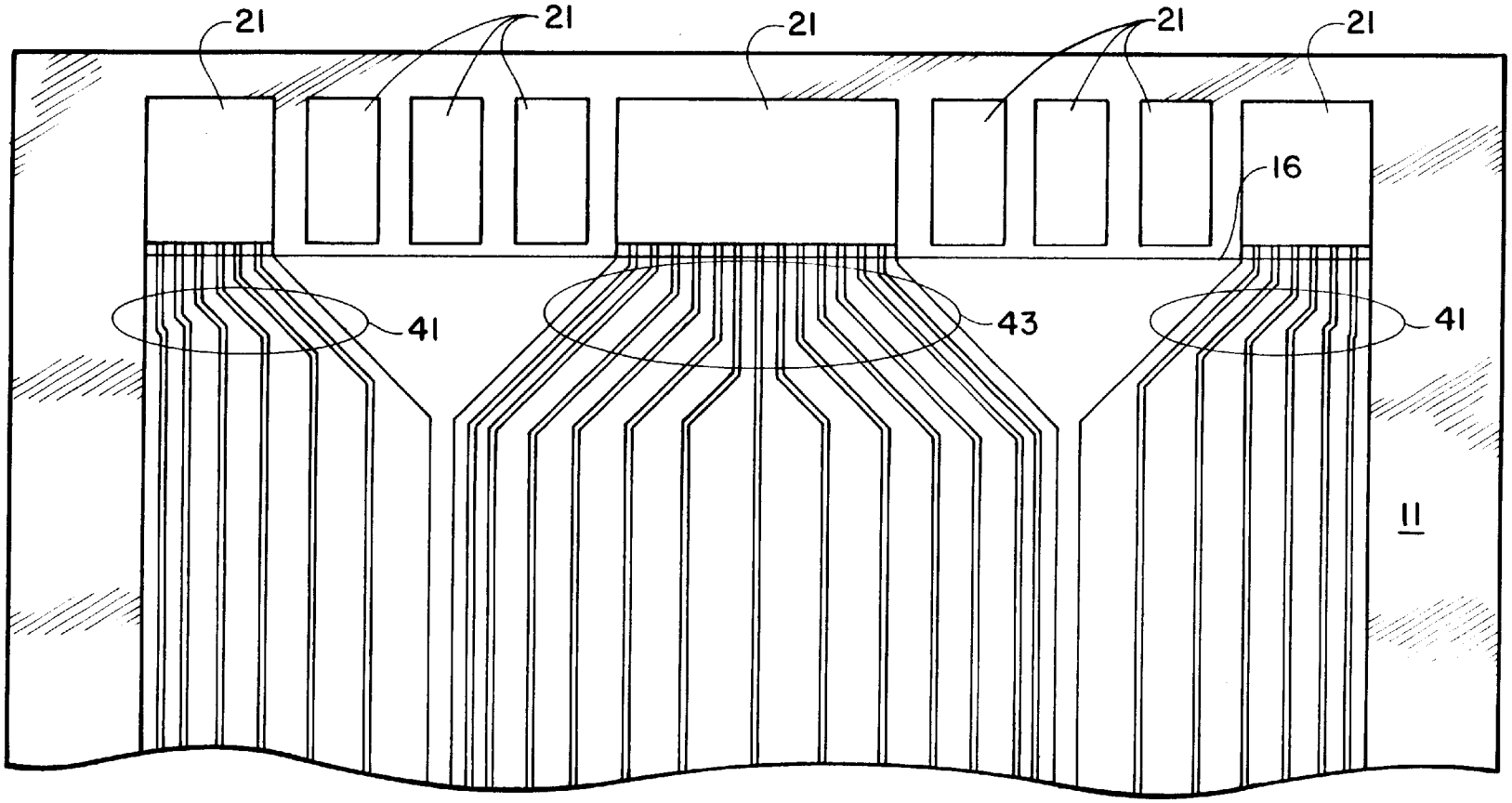
FIG. 3 is a schematic top plan view of a portion of the conventional ink-jet printhead of FIG. 1.

With reference now to FIG. 3, there is shown a schematic top plan view of a portion of the conventional printhead 5. In this printhead, gold power lines 41 and gold ground lines 43 are routed under the ink barrier layer edge 16 to be electrically coupled to their respective bond pads 21.

Figure 4:
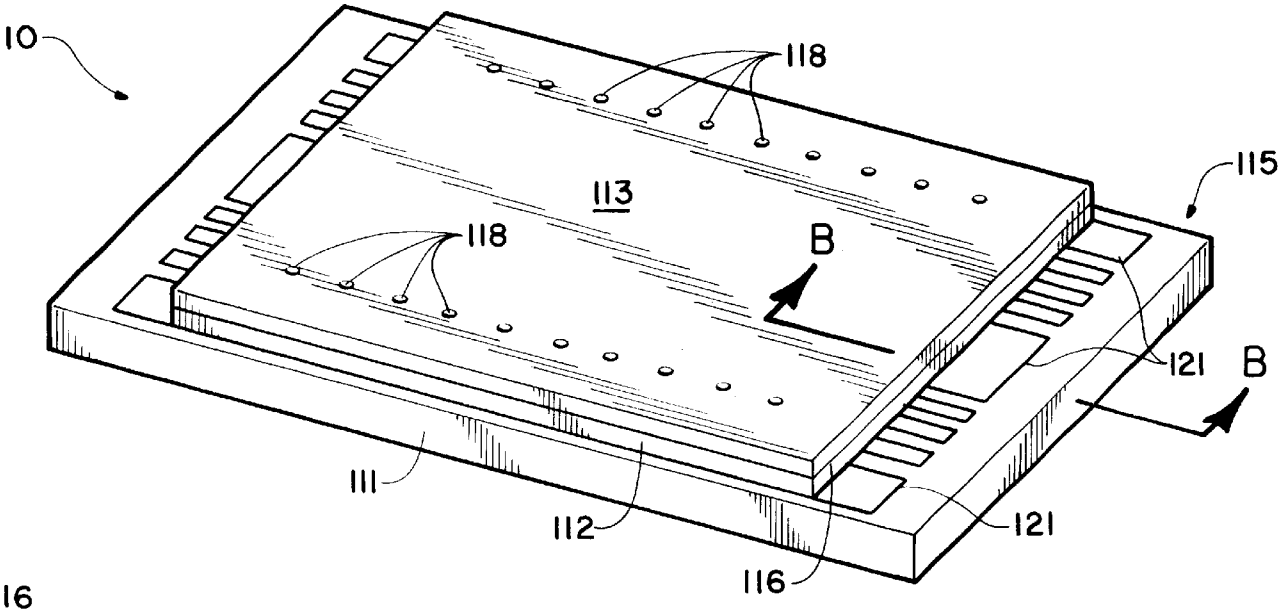
FIG. 4 is an unscaled schematic perspective view of an ink-jet printhead which is constructed according to the present invention.
Figure 5:
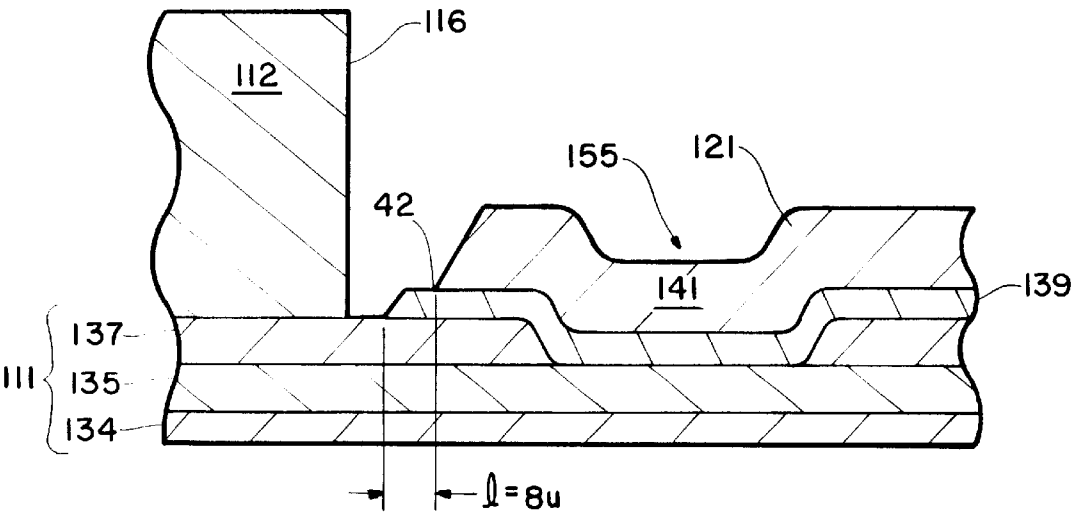
FIG. 5 is an unscaled schematic view of the ink-jet printhead of FIG. 4, taken along the line B—B thereof showing the barrier/substrate interface according to the present invention.
Figure 6:
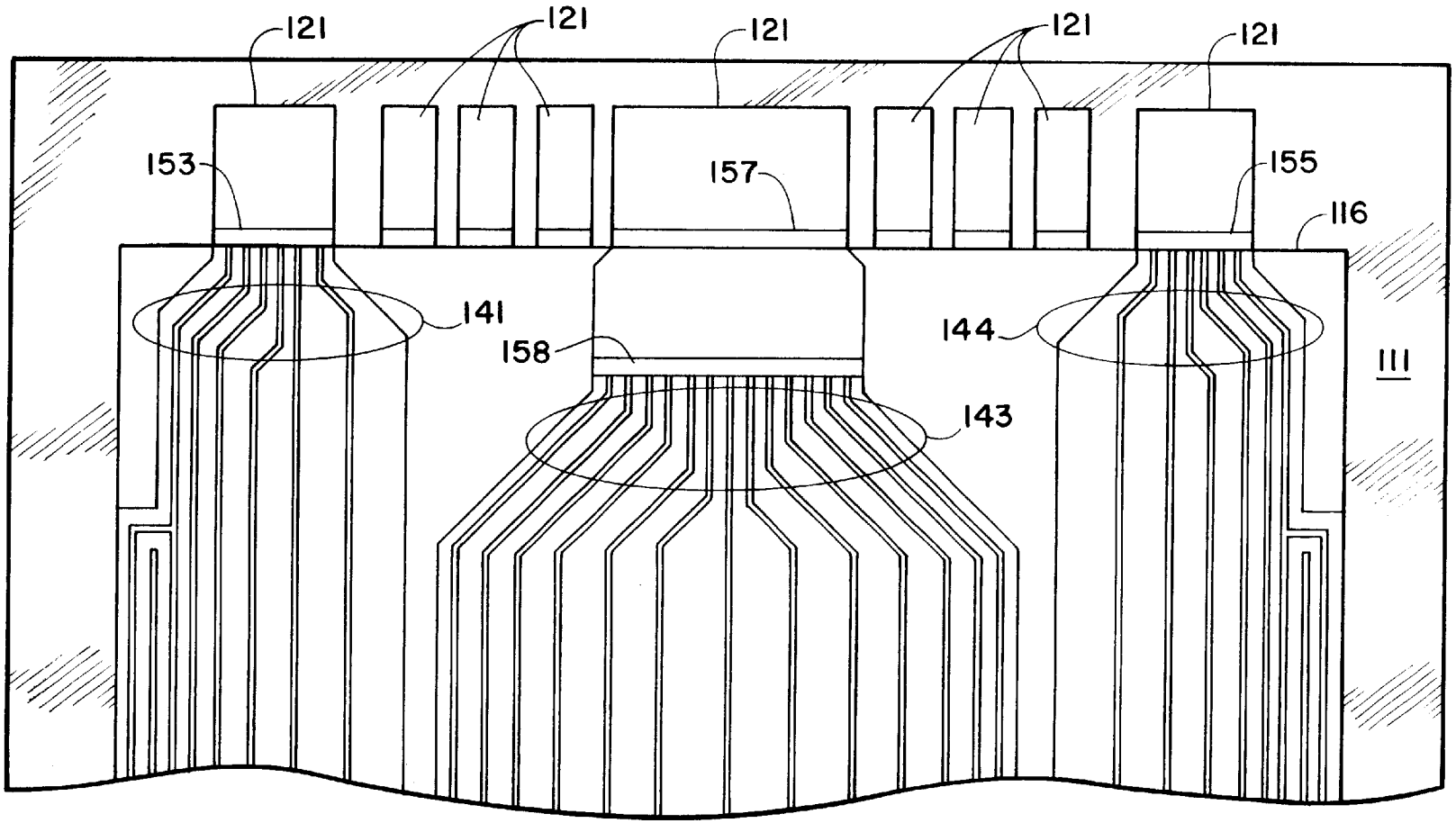
FIG. 6 is a schematic top plan view of a portion of an ink-jet printhead constructed according to the present invention.

Referring now to FIGS. 4–6, there are shown several views of a printhead 10 which is constructed according to the present invention. The printhead 10 is similar in some respects to the printhead 5 having (a) a thin film substructure or die 111 comprising a substrate such as silicon and having various thin film layers formed thereon, (b) an ink barrier layer 112, disposed on the thin film substructure 111, and (c) an orifice or nozzle plate 113 attached to the top of the ink barrier layer 112.

The thin film substructure 111 is formed according to conventional integrated circuit techniques and includes a plurality of stacked thin film layers and it includes a portion 115 that extends beyond an ink barrier layer first edge 116.

As in the case of the printhead 5, the ink barrier 112 is formed of a dry film that is pressure laminated to the thin film substrate 111 or a wet dispensed liquid cast film that is subsequently spun to uniform thickness and dried by driving off excess solvent. The barrier layer 112 is formed of a dry film photo defined to form therein ink chambers (not shown) and ink channels (not shown) which are disposed over resistor regions (not shown).

Gold and tantalum bond pads 121 engagable for external electrical connections are located on the portion 115 at the end of the thin film substrate 111. As in the prior art printhead 5, the bond pads 121 are not covered by the ink barrier layer 112. An orifice plate 113 is similar in structure and function to its counterpart in the printhead 5.

FIG. 5 depicts the novel relationship between the barrier layer 112 and the thin film substrate 111, as it exits in the printhead 10. The thin film substrate 111 includes a portion 115 which extends beyond the barrier layer 112. The substrate 111 includes a passivation layer 137, of silicon nitride ($Si_3N_4$) and silicon carbide (SiC) composition, formed over an aluminum layer 135 which, in turn, is disposed over a tantalum/aluminum layer 134. A tantalum thin film layer 139 overlies the passivation layer 137 while a gold thin film layer 141 overlies the tantalum layer 139. The electrically conductive thin film layer 135 could alternatively be composed of other electrically conductive materials including aluminum/copper.

It is recognized that while the material of the ink barrier 112 does not bond well with gold, it does bond well with silicon compositions, such as those disposed in the passivation layer 137. In view of this, in a preferred embodiment of the present invention, a via, indicated generally by the reference numeral 155 is provided. As best shown in FIG. 5, the via 155 enables use of metal-2 aluminum layer 135 for power and ground line routing under the ink barrier layer first edge 116 where electrical shorting most frequently occurs. In this manner, while gold is still bonded to the bond pads 121, power and ground lines are dropped through the via 155 to the underlying aluminum layer. The via shown in FIG. 5 is filled with the tantalum layer 139 underlying the gold layer 141. The via could be filled with other conductive films including aluminum. As more fully discussed with reference to FIG. 6, ground lines are returned to the gold thin film layer 141 at a location about 200 $\mu$m inboard of the ink barrier edge 116 while the power lines are routed to the opposite end of the die 111 in the aluminum thin film layer 135.

One skilled in the art will realize that, by using the via 155 as described, the gold layer 141 and the tantalum layer 139can be removed from the substrate 111 in the printhead region beyond the bond pad 121 extending under the ink barrier layer edge 116. As a result, a significant advantage over the prior art is realized since the ink barrier layer 112 now can be bonded firmly to the passivation layer 137. In this manner, delamination problems in this region of the printhead 10 are substantially eliminated. Of course, another advantage of the present invention is the elimination of topography resulting from the removal of gold and tantalum from the thin film stack. In a preferred embodiment of the present invention, the tantalum layer 139 extends for a distance 1 of about 8 $\mu$m beyond a location 42 where the gold layer 141 ends.

With reference now to FIG. 6, there is shown a schematic top plan view of a portion of the printhead 10 which is constructed according to the present invention. Power lines 142 and 144, and gold lines 143, are elctrically coupled to their respective bond pads 121 and are routed, respectively, under an ink barrier edge 116 by means of vias 153, 155 and 157. These vias are similar in structure and function to the via 155 and they serve to couple electrically the bond pads 121 and the metal-2 aluminum thin film layer 135. In this manner, the power and ground lines are routed under the ink barrier layer 112.

Since the voltage in the ground lines 143 is respectively low, in comparison to the power lines 142 and 144, they are recoupled at a via 158 to the gold thin film layer 141. The via 158 is located at a pace within the die about 200 $\mu$m from the barrier edge 116. The higher voltage power lines 142 and 144, on the other hand, remain in the metal-2 aluminum layer 135 for the full length between opposite bond pad regions.

As a result of routing and ground lines as described, the composite passivation layer 137 can be exposed to the ink barrier layer 112 to which it can be securely bonded. In this regard, the silicon carbide (SiC) of the passivation layer 137 is reactivated with a $CF_4$ dry etch to enhance adhesion of the IJ5000 barrier material to the SiC. Thus, several advantages are afforded. The problem of failure of the gold thin film layer 141 to bond to the barrier layer 112 is eliminated and the likelihood of electrical shorting under the barrier is substantially eliminated. In addition, costs savings are realized since the need for developing a barrier layer overcoating technology no longer exists. Further, topography problems caused by the presence of gold and tantalum at the ink barrier edge, since the barrier conventionally steps over the gold tantalum, are eliminated.

According to the present invention, electrical current routing occurs in two different metals: gold and aluminum. Aluminum has a higher resistance to current flow than gold. However, added parasitic losses can be held to fractions of an ohm if the power and ground lines are rebalanced to account for the differences in resistivity of aluminum and gold. This can be accomplished, for example, by suitable adjustment of the widths and lengths of the relative thin film layers.

In view of the foregoing, the present invention provides an effective and efficient technique for accomplishing passivation in the regions near the ends of the die. As a result, a novel printhead that is compatible with corrosive inks and having a capacity for a longer life is provided.

One skilled in the art will realize that while the invention has been described with respect to printheads utilizing the outer edge fed configuration, it can be employed also, in a center edge fed ink-jet printhead such as that disclosed in previously identified U.S. Pat. No. 5,317,346, incorporated herein by reference. In the latter configuration, the ink channels open towards an edge formed by a slot in the middle of the thin film substrate.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. An ink-jet printhead, comprising:

a thin film substrate, said substrate including a plurality of thin film layers, said plurality including a passivation layer and an electrically conductive thin film layer underlying said passivation layer;

an ink barrier layer overlying said thin film substrate, said ink barrier layer defining ink chambers and ink channels, said ink barrier layer having a peripheral edge, said substrate further including a substrate portion extending beyond said ink barrier layer peripheral edge;

a bond pad disposed on said substrate portion adjacent said ink barrier layer peripheral edge; and means for coupling electrically said bond pad to said electrically conductive thin film layer at a location within said substrate portion.

2. The ink-jet printhead according to claim 1, wherein said means for coupling includes a via.

3. The ink-jet printhead according to claim 1, wherein said means for coupling includes a plurality of vias.

4. The ink-jet printhead according to claim 2, wherein said via includes tantalum.

5. The ink-jet printhead according to claim 3, wherein said electrically conductive thin film layer comprises a plurality of aluminum traces.

6. The ink-jet printhead according to claim 1, wherein said thin film substrate includes a plurality of electrically conductive traces.

7. The ink-jet printhead according to claim 6, wherein said plurality of electrically conductive traces includes power lines and ground lines.

8. The ink-jet printhead according to claim 1, wherein said passivation layer includes silicon.

9. The ink-jet printhead according to claim 1, wherein said passivation layer includes silicon carbide and silicon nitride.

10. The ink-jet printhead according to claim 1, wherein said thin film substrate includes a second electrically conductive thin film layer.

11. The ink-jet printhead according to claim 1, wherein one of said plurality of thin film layers is selected from the group consisting of aluminum/copper and tantalum/aluminum.

12. The ink-jet printhead according to claim 1, including a region adjacent said ink barrier layer peripheral edge where said ink barrier layer directly adheres to said passivation layer.

13. A method of producing an ink-jet printhead, comprising the steps of:

providing a thin film substrate, said substrate including a plurality of thin film layers including a passivation layer and electrically conductive thin film layers, at least one of said electrically conductive thin film layers underlying said passivation layer, said electrically conductive thin film layers forming electrically conductive traces, an ink barrier layer overlying said thin film substrate, said ink barrier layer defining ink chambers and ink channels, said ink barrier layer having a peripheral edge, said substrate further including a substrate portion extending beyond said ink barrier layer peripheral edge, and a plurality of bond pads disposed on said substrate portion adjacent said ink barrier layer peripheral edge; and coupling said electrically conductive thin film layers to said plurality of bond pads, thereby routing electric current under said passivation layer.

14. The method according to claim 13, wherein said electrically conductive traces include power and ground traces.

15. The method according to claim 13, including bonding said ink barrier layer peripheral edge directly to said passivation layer.

16. The method according to claim 13, wherein said coupling step includes providing a plurality of vias.

17. The method according to claim 13, wherein said coupling step includes providing a plurality of vias each one of said plurality of vias being comprised of tantalum.

18. The method according to claim 13, wherein said providing a thin film substrate includes the steps of providing a thin film layer of gold overlying said passivation layer and coupling at least one of said electrically conductive thin film layers underlying said passivation layer to said gold layer at a location separated from said ink barrier layer peripheral edge.

19. The method according to claim 18, wherein said coupling includes using a via to couple electrically said electrically conductive layer to said gold thin film layer.

* * * * *